US006217365B1

(12) United States Patent
Shinozaki

(10) Patent No.: US 6,217,365 B1
(45) Date of Patent: Apr. 17, 2001

(54) CONNECTOR

(75) Inventor: Tetsuya Shinozaki, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/447,404

(22) Filed: Nov. 23, 1999

(30) Foreign Application Priority Data

Nov. 26, 1998 (JP) ..... 10-336179

(51) Int. Cl.[7] ..... H01R 13/627; H01R 13/00
(52) U.S. Cl. ..... 439/358; 439/484
(58) Field of Search ..... 439/357, 358, 439/483, 484

(56) References Cited

U.S. PATENT DOCUMENTS 5,378,168 * 1/1995 Sumida ..... 439/358
5,380,217 1/1995 Yagi et al. ..... 439/358
5,399,045 * 3/1995 Yoneda et al. ..... 403/321
5,425,650 * 6/1995 Maeda ..... 439/374
5,613,881 * 3/1997 Ichida et al. ..... 439/680
5,711,684 * 1/1998 Inoue et al. ..... 439/354
5,775,932 * 7/1998 Saito et al. ..... 439/378

* cited by examiner

*Primary Examiner*—Paula Bradley
*Assistant Examiner*—Edwin A. León
(74) *Attorney, Agent, or Firm*—Anthony J. Casella; Gerald E. Hespos; Michael J. Porco

(57) ABSTRACT

A connector with an elastic locking portion is formed to avoid exerting tension on a wire when the connector is disengaged from its mating connector. The elastic locking portion 28 is elastically deformable upward and downward on the top surface of a connector 20, and a pulling portion 34 projects at the rear side of the elastic locking portion 28. When the connector 20 connected with a mating connector is to be disengaged therefrom, the connectors are pulled in detaching directions while the elastic locking portion 28 is pressed. Since the connector 20 can be pulled by maneuvering the pulling portion 34 at this time, no tension is forcibly exerted on a wire.

9 Claims, 10 Drawing Sheets

CONNECTOR

BACKGROUND OF THE INVENTION

1. Field of the Invention

The present invention relates to a connector.

2. Description of the Related Art.

FIGS. 12 to 15 show a pair of mateable prior art connectors 100, 101. The connectors also are disclosed in U.S. Pat. No. 5,380,217. The engaging ends of the connectors 100, 101 are referred to herein as front ends. As shown in FIG. 13, an elastic locking portion 102 extends backwardly from the front end of the top surface of the connector 100, and is elastically deformable upwardly and downwardly. A locking projection 102A projects from the lower surface of the elastic locking portion 102 in a position toward the front end.

An engaging portion 103 projects from the front side of the top surface of the mating connector 101. The connectors 100, 101 are locked into each other by the engagement of the locking projection 102A with the engaging portion 103. Further, a pushing portion 102B is provided on the upper surface of the rear end of the elastic locking portion 102. By pressing the pushing portion 102B, a middle part (behind the locking projection 102A) of the elastic locking portion 102 can be deformed elastically in an upward direction.

During a connecting operation of the prior art connectors 100, 101, the engaging portion 103 contacts the locking projection 102A, and pushes the middle part of the elastic locking portion 102 upwardly in an elastic deformation. This deflected state of the elastic locking portion enables the connection to progress (see FIG. 14). When the connectors 100, 101 are properly connected, the engaging portion 103 stops the upward pushing of the locking projection 102A. As a result the elastic locking portion 102 is restored to its original shape. Thus, the locking projection 102A and the engaging portion 103 are engaged to lock the connectors 100, 101 into each other (see FIG. 15).

To disengage the pair of connectors from their connected state, the pushing portion 102B is first pushed to elastically deform the elastic locking portion 102. The connectors 100, 101 then are urged in directions away from each other while the locking projection 102A and the engaging portion 103 are disengaged. During this time, a hand pressing the elastic locking portion 102 pulls the connector 100. Accordingly, the connectors are unlocked by pushing and detached by pulling simultaneously. Since no particular hook convenient to detach the connector 100 is provided in the vicinity of the elastic locking portion 102, the connector 100 may be detached improperly by pulling a wire w connected with a terminal fitting 104.

In view of the above problem, an object of the present invention is to provide a connector formed with an elastic locking portion, and which can be disengaged from a mating connector without exerting tension on a wire.

SUMMARY OF THE INVENTION

According to the invention, there is provided a connector, comprising an elastic locking portion to hold the connector and a mating connector in a connected state by engaging an engaging portion of the mating connector. The elastic locking portion is -elastically deformable in at least one direction substantially normal to a connecting or mating direction with the mating connector. A pulling portion is provided at the rear side of the elastic locking portion, which is a side opposed to a mating side of the connector. The pulling portion enables or facilitates the gripping or maneuvring or manipulation of the connector when the elastic locking portion is deformed or displaced elastically out of engagement with the engaging portion, thereby enabling the connector to be detached from the mating connector.

To detach the connected connectors, the elastic locking portion and the engaging portion are disengaged while the elastic locking portion is elastically deformed. In this state, the connectors are pulled in directions away from each other. Since the pulling portion is provided at the rear side of the elastic locking portion, the connectors can be detached by maneuvering the pulling portion. Thus, an undesirable situation where a tension is forcibly exerted on an unillustrated wire connected with a terminal fitting can be avoided.

According to a preferred embodiment of the invention, the projecting height of the pulling portion is higher than that of the elastic locking portion when being elastically deformed to unlock the connectors. Additionally, the projecting height of the pulling portion preferably is higher than that of the elastic locking portion in its natural state where no force is acting thereon. Accordingly, since the projecting height of the pulling portion is set higher than that of the elastic locking portion in the natural state, the direction of an unintended external force on the elastic locking portion can be prevented. Thus, an undesirable situation where the elastic locking portion and the engaging portion are inadvertently disengaged can be avoided.

Further preferably, one or more protection pieces are provided so as to substantially surround at least a portion of the elastic locking portion from sides other than a mating side of the connector with its mating connector. Accordingly, the elastic locking portion is protected from being inadvertently manipulated, displaced or deformed e.g. by an external object hitting the connector from a lateral side or a back side. Most preferably, the protection pieces have substantially the same projecting height as the pulling portion.

According to a further preferred embodiment, the elastic locking portion is formed with a pushing portion for manipulating the elastic locking portion to deflect in the deflection direction. Accordingly, the manipulation of the elastic locking portion is facilitated when disconnecting the connectors.

Preferably, the pushing portion is formed by transversely widening the elastic locking portion.

According to still a further preferred embodiment, the connector comprises a housing main body and one or more covers mountable on a rear side of the housing main body. The elastic locking portion is provided on the housing main body and the pulling portion is provided on the one or more covers.

Preferably, a manipulating or hook portion is provided on a side of the connector substantially opposed to the side on which the pulling portion is provided. Accordingly, when the connectors are to be disengaged, the disengagement can be efficiently performed by exerting forces on both the puling portion and the manipulating portion.

These and other objects, features and advantages of the present invention will become more apparent upon a reading of the following detailed description and accompanying drawings.

DETAILED DESCRIPTION OF THE PREFERRED EMBODIMENT

Figure 1:
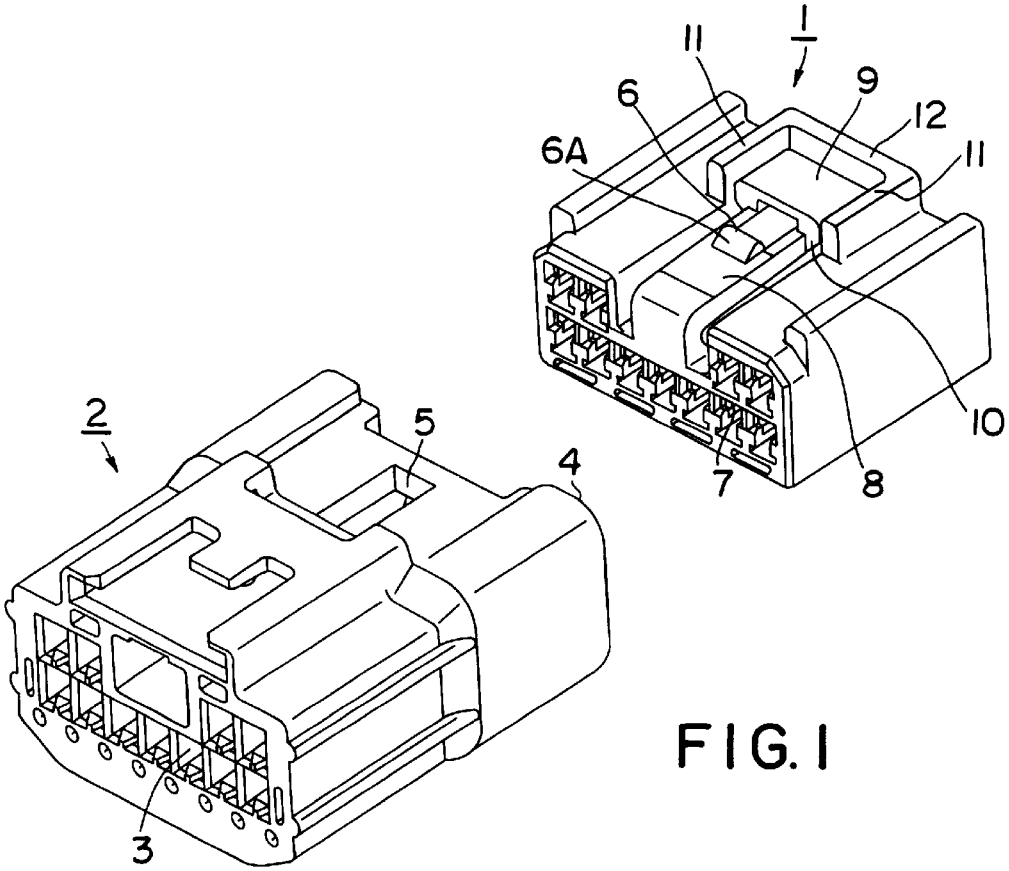
FIG. 1 is a perspective view of connectors according to a first embodiment before being connected.

A pair of connectors in accordance with the invention are identified by the numerals 1 and 2 in FIG. 1. The connectors 1, 2 are configured to be at least partly connectable or mateable with each other, before they are fully connected. Female terminal fittings are provided in the connector 1, and male terminal fittings are provided in the mating connector 2. The terminal fittings are constructed to be coupleable with each other. However no description is given of the terminal fittings for the sake of convenience.

The mating connector 2 is made integrally, for example, of a synthetic resin. Cavities 3 are formed inside the mating connector 2 and unillustrated male terminal fittings are at least partially mountable in the cavities 3. A receptacle 4 is provided in front of the cavities 3. In this regard, the engaging ends of the connectors 1, 2 are referred to as front ends. The connector 1 can be accommodated at least partially in the receptacle 4. An engaging portion 5 is provided in the lateral or upper surface of the receptacle 4, and preferably in a position toward the front end. A locking projection 6 of the connector 1 to be described later is engaged or engageable with the engaging portion 5 to lock the connectors 1, 2 into or with each other.

The connector 1 is an integral box-shaped structure that is formed, for example, of a synthetic resin with cavities 7 extending therethrough for accommodating the unillustrated female terminal fittings. The connector 1 is configured to be substantially equal to or slightly smaller than a space defined inside the receptacle 4.

Figure 2:
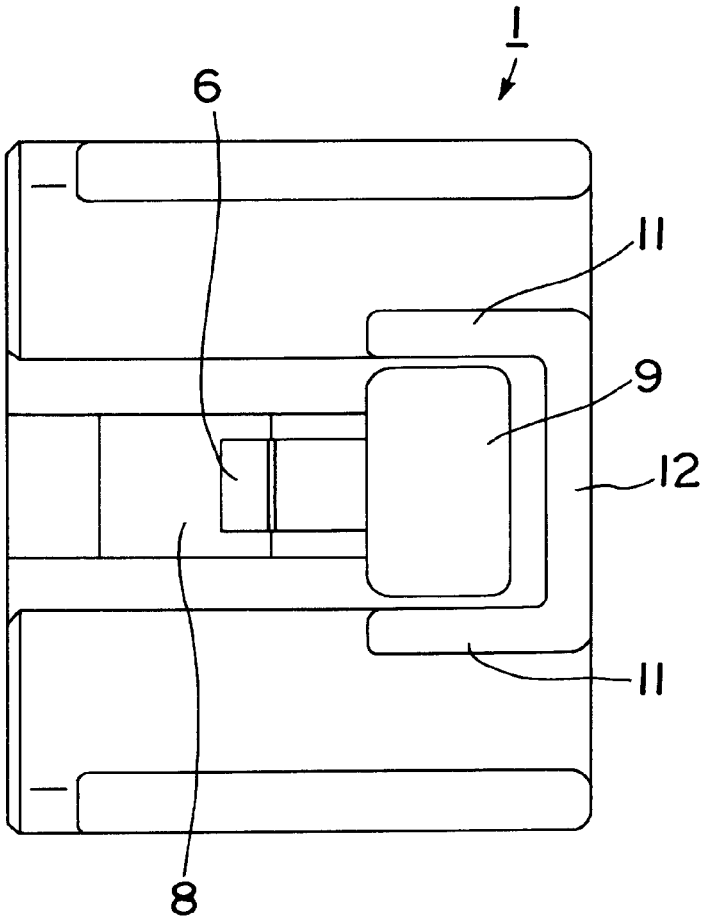
FIG. 2 is a plan view of the connector.
Figure 5:
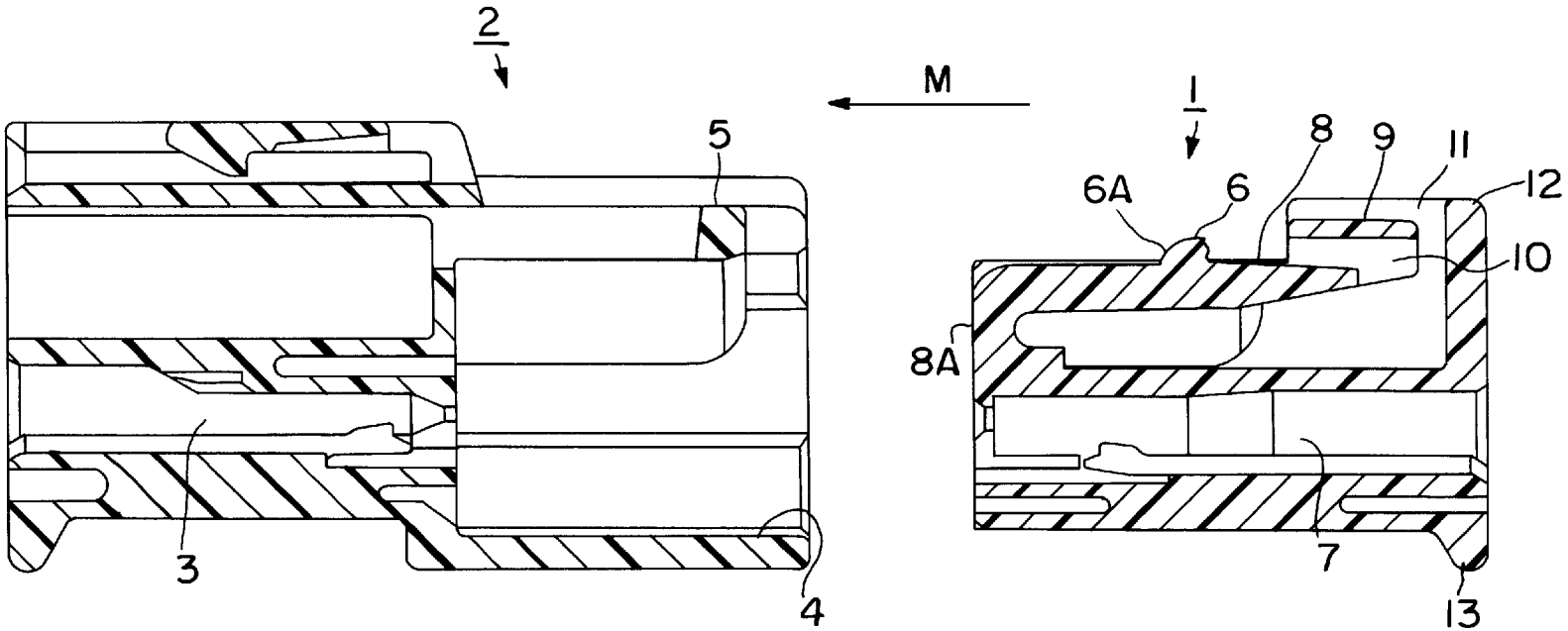
FIG. 5 is a side view in section of the connectors before a connecting operation.

An elastic locking portion 8 projects backwardly from the front end of the connector 1 from a location substantially in the middle of the top surface of the connector 1. The elastic locking portion 8 is cantilevered with only its base end 8A at the front end connected with the top surface of the connector 1. Additionally, the elastic locking portion 8 is elastically deformable or displaceable along a deformation direction D towards and away from the connector 1, e.g. upwardly and downwardly as a whole. The locking projection 6 projects upwardly substantially in the middle of the elastic locking portion 8 in a position corresponding to the engaging portion 5. The rear side (right side in FIG. 5) of the locking projection 6 preferably extends substantially vertically, whereas the front side thereof preferably is formed into a moderately sloped guide surface 6A so as to smooth the engagement with the engaging portion 5. A pushing portion 9 is provided substantially at the rear end of the elastic locking portion 8 or in a position or side substantially opposed to the mating side of the connector 1 with the mating connector 2. The pushing portion 9 preferably is connected with the elastic locking portion 8 via connecting pieces 10 which preferably extend upwardly from the lateral or left and right edges (upper and lower sides of the pushing portion 9 in FIG. 2) of the elastic locking portion 8. The elastic locking portion 8 can be deformed elastically by pressing the pushing portion 9.

A pair of protection pieces 11 project at the lateral or left and right sides of the elastic locking portion 8 at the rear end of the top surface of the connector 1. The projecting height of the protection pieces 11 is so set as to be higher than that of the pushing portion 9 when the elastic locking portion 8 is not elastically deformed, i.e. in its natural state. Thus, the elastic locking portion 8 is protected from external forces acting in transverse directions by the protection pieces 11, to prevent the elastic locking portion from inadvertent elastic deformation. The rear ends of the protection pieces 11 preferably are connected by a pulling portion 12, which projects up to the same height as the protection pieces 11, so that it is located higher than the pushing portion 9 in its substantially natural state, preferably when the two connectors 1, 2 are connected or mated. Alternatively, the pulling portion 12 may be spaced from the protection pieces 11 by a predetermined distance or space. In this way, at least a portion of the elastic locking portion 8, preferably its pushing portion 9, has its three sides: left, right and rear sides substantially surrounded by the protection pieces 11 and the pulling portion 12.

Figure 3:
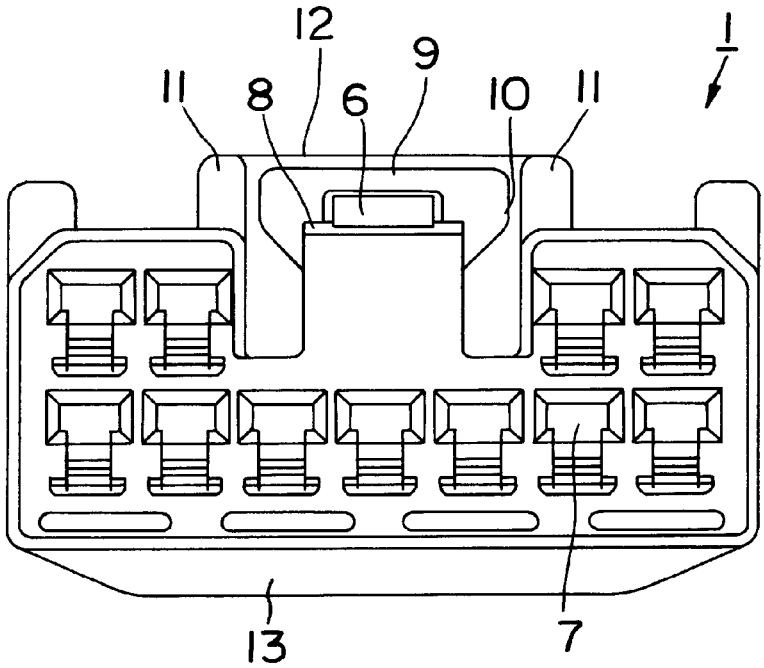
FIG. 3 is a front view of the connector.
Figure 4:
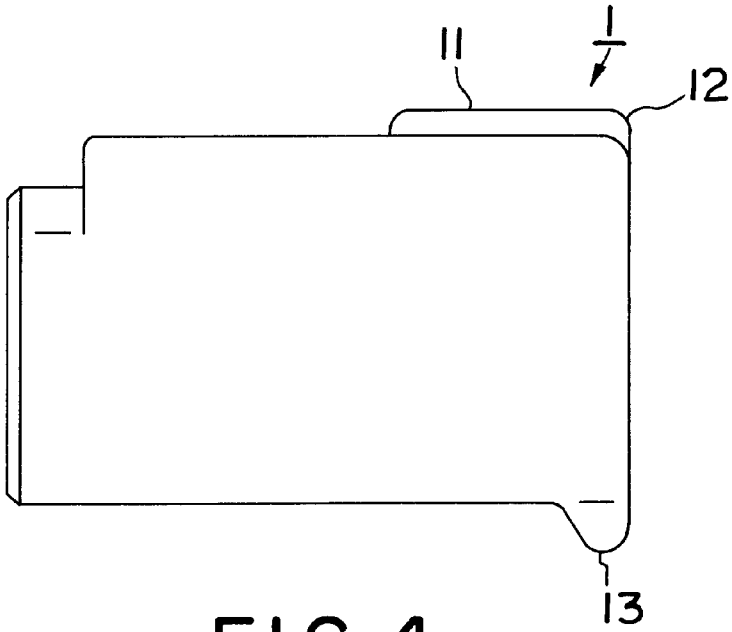
FIG. 4 is a side view of the connector.

Further, a hook portion 13 projects downwardly substantially from the rear edge of the bottom surface of the connector 1, as shown in FIGS. 3 and 4. When the connectors 1, 2 are disengaged, the connector 1 can be pulled smoothly by using the pulling portion 12 and the hook portion 13 provided respectively at the top and bottom sides of the connector 1.

Figure 6:
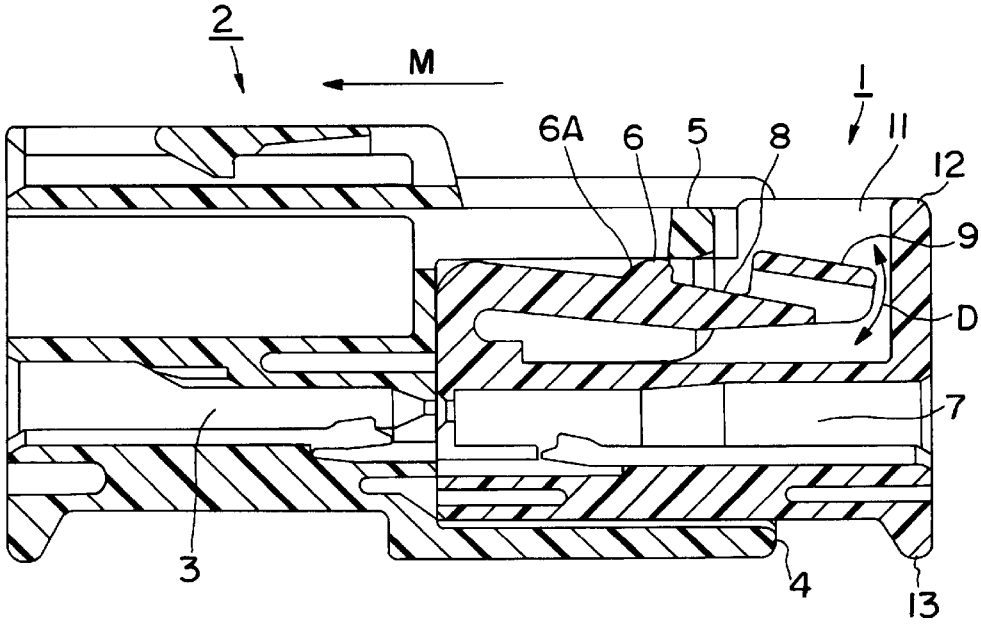
FIG. 6 is a side view in section of the connectors during the connecting operation.

When the connectors 1, 2 are to be connected, the connector 1 first is located in front of the receptacle 4 of the mating connector 2 and then is pushed into the receptacle 4 in a mating or insertion direction M. When the connectors 1, 2 reach a specified engaged state, the engaging portion 5 and the locking projection 6 come into contact with each other. When the connectors 1, 2 are pushed toward each other at this stage, the guide surface 6A of the locking projection 6 slips under the engaging portion 5, which then pushes the locking projection 6 downwardly. In this way, the connecting operation progresses while the elastic locking portion 8 is deformed elastically downwardly (see FIG. 6).

When the connectors 1, 2 are connected properly, the engaging portion 5 stops pushing the locking projection 6, with the result that the elastic locking portion 8 is restored preferably substantially to its original shape. Then, the engaging portion 5 and the locking projection 6 are engaged properly to hold the connectors 1, 2 connected (see FIG. 7).

Since the pushing portion 9 of the elastic locking portion 8 has its three sides surrounded by the protection pieces 11 and the pulling portion 12 while the connectors 1, 2 are connected with each other, an undesirable situation can be avoided where the elastic locking portion 8 inadvertently is deformed and disengaged from the engaging portion 5.

Figure 7:
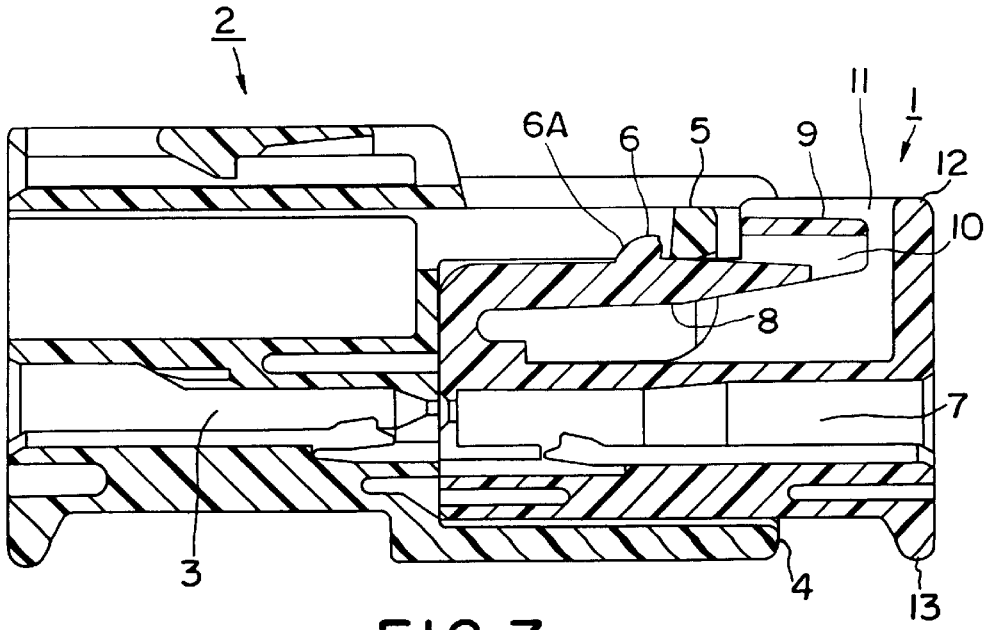
FIG. 7 is a side view in section of the connectors after the connecting operation.
Figure 8:
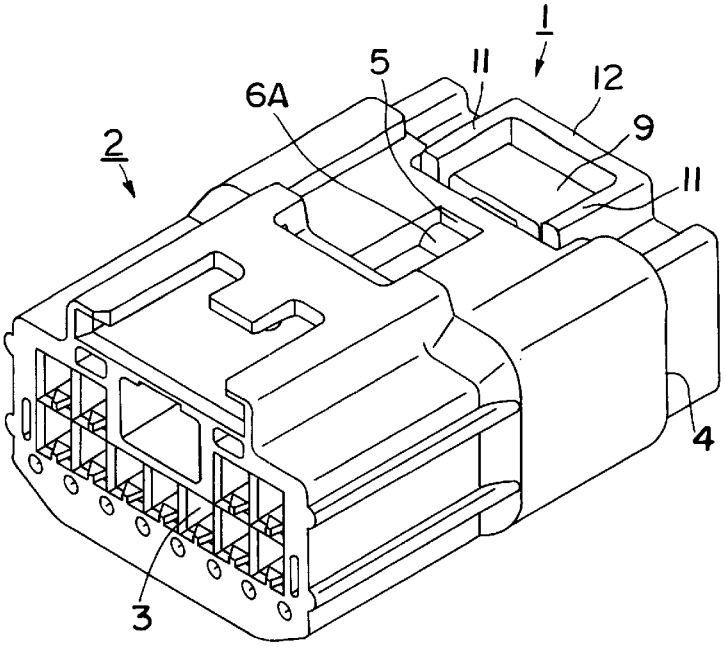
FIG. 8 is a perspective view of the connectors after the connecting operation.
Figure 9:
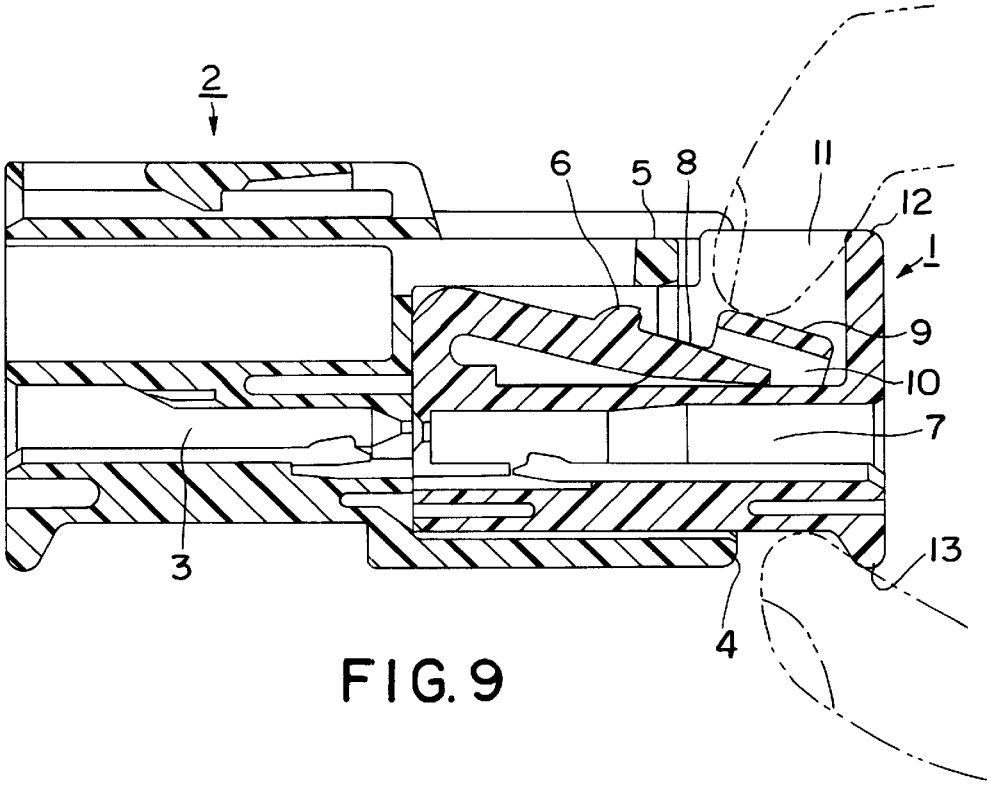
FIG. 9 is a side view in section of the connectors being detached.

To detach the connected connectors 1, 2, the pushing portion 9 first is pressed in the state shown in FIG. 7 or 8 to deform the elastic locking portion 8 elastically. The engaging portion 5 and the locking projection 6 then are disengaged or disengageable, and the connectors 1, 2 are or can be pulled apart (see FIG. 9). At this time, since the pulling portion 12 is provided at the rear side of the elastic locking portion 8, the pulling operation can be performed smoothly. Further, the hook portion 13 is provided on the bottom surface of the connector 1 substantially opposite the pulling portion 12. Thus the connector 1 can be pulled by holding the portions 12, 13 from above and below, and the pulling operation can be performed more smoothly.

The connected connectors 1, 2, of this embodiment are detached by elastically deforming the elastic locking portion 8 out of engagement with the engaging portion 5, and then pulling the connectors 1 and 2 in directions away from each other. Since the pulling portion 12 is provided at the rear side of the elastic locking portion 8, the connectors 1, 2 can be detached by maneuvering the pulling portion 12. Thus, an undesirable situation where a tension is exerted forcibly on an unillustrated wire connected with a terminal fitting can be avoided.

Since the projecting height of the pulling portion 12 is set higher than that of the elastic locking portion 8 in its substantially natural state, such as when the two connectors 1, 2 are mated (FIG. 9), direct action of an external force on the elastic locking portion 8 can be prevented. Thus, an undesirable situation where the elastic locking portion 8 and the engaging portion 5 are inadvertently disengaged while the connectors 1, 2 are connected can be avoided.

Figure 10:
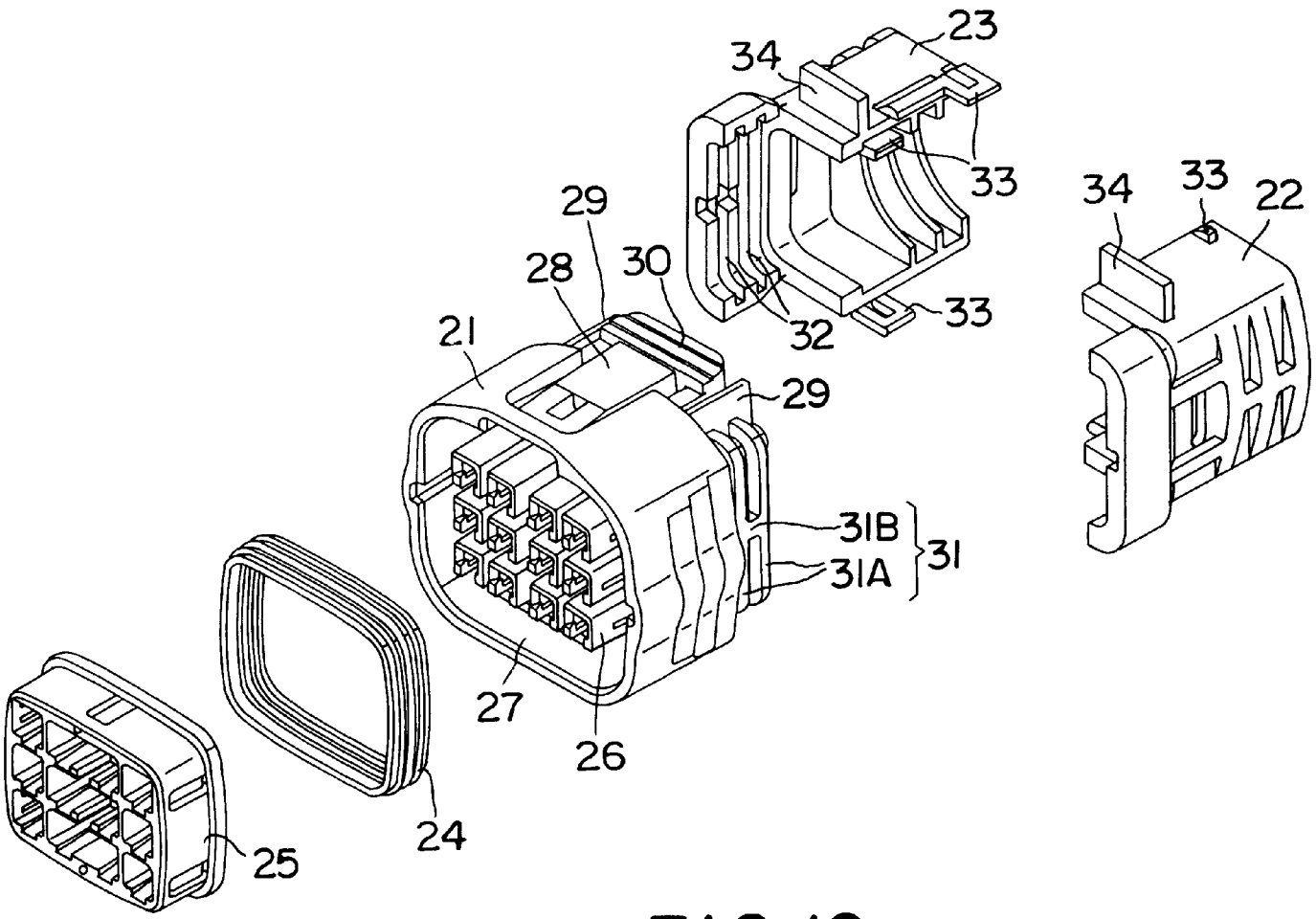
FIG. 10 is an exploded perspective view of a connector according to a second embodiment.
Figure 11:
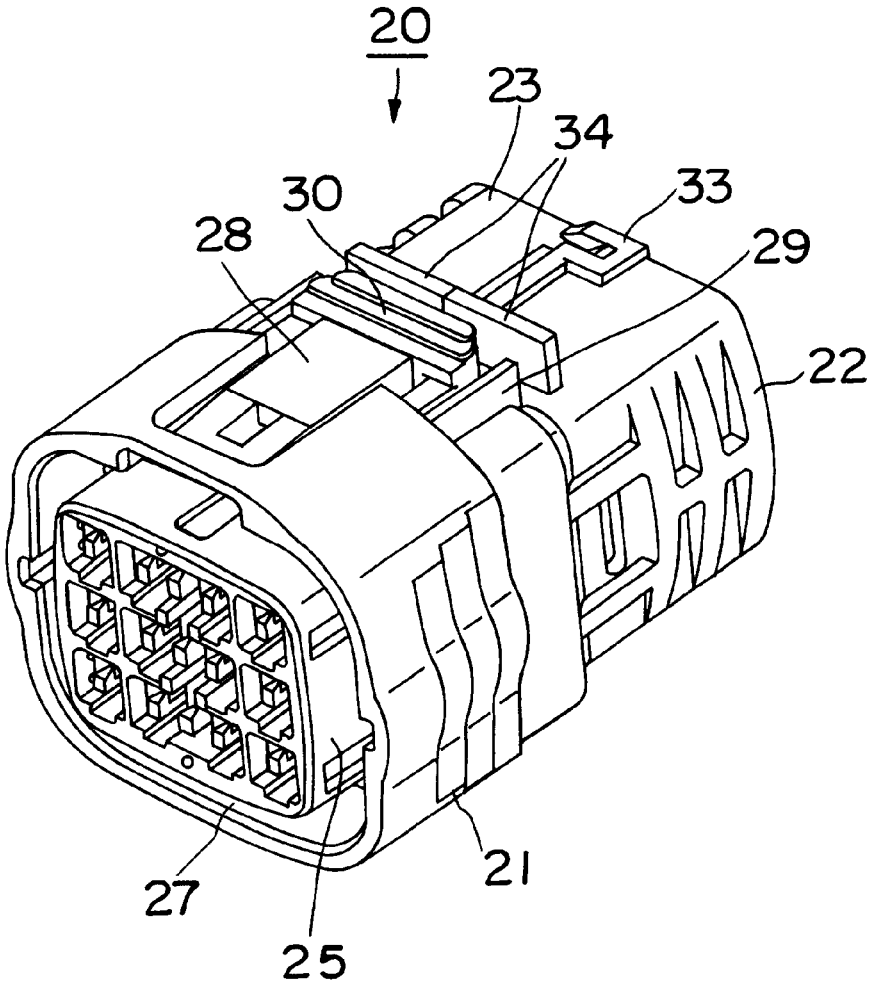
FIG. 11 is a perspective view of the connector of FIG. 10.
Figure 12:
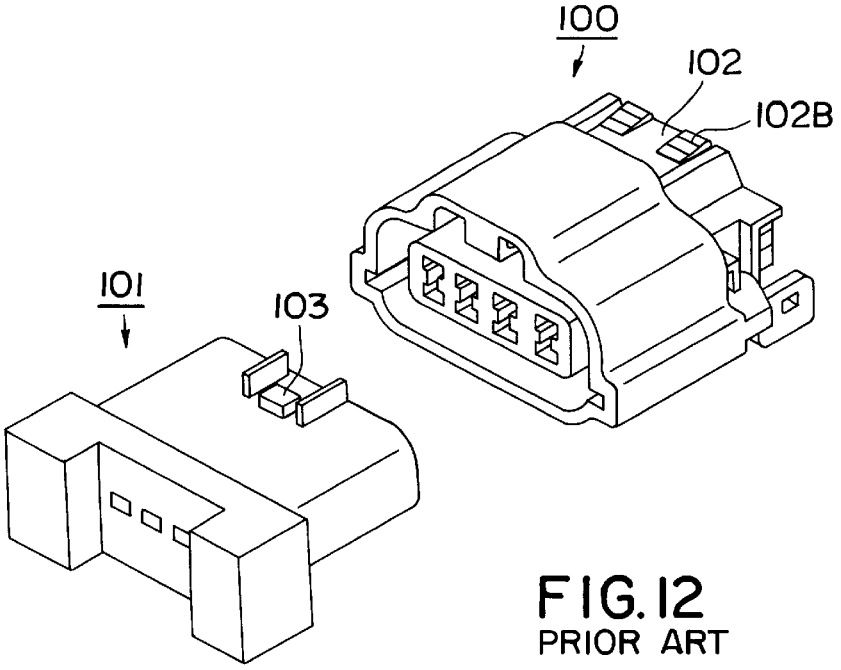
FIG. 12 PRIOR ART
FIG. 12 is a perspective view of prior art connectors before a connecting operation.
Figure 13:
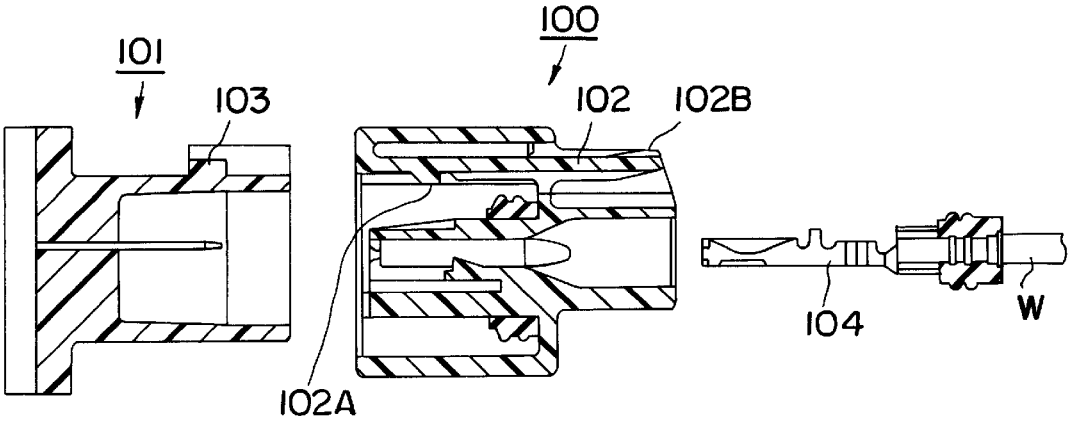
FIG. 13 PRIOR ART
FIG. 13 is a side view in section of the prior art connectors before the connecting operation.
Figure 14:
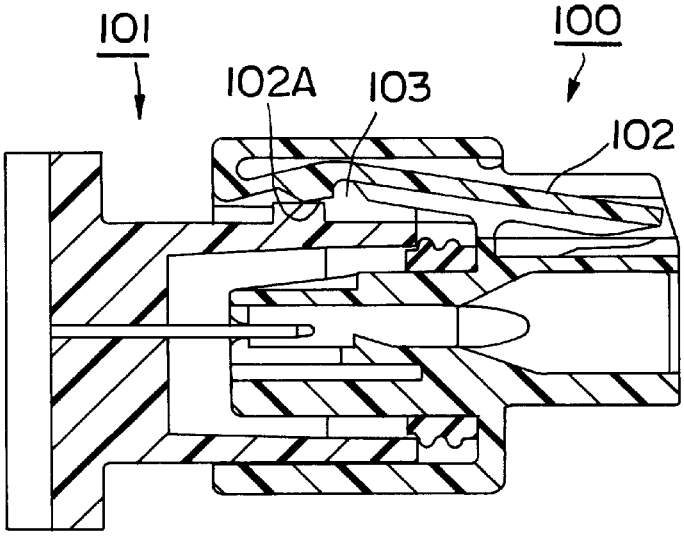
FIG. 14 PRIOR ART
FIG. 14 is a side view in section of the prior art connectors during the connecting operation.
Figure 15:
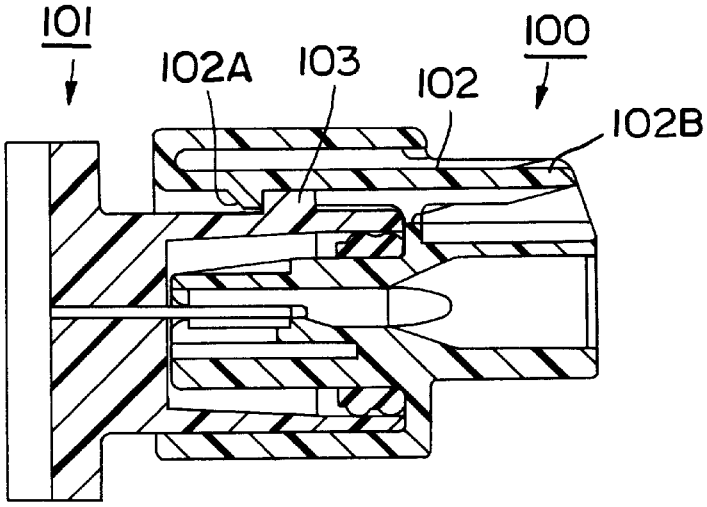
FIG. 15 PRIOR ART
FIG. 15 is a side view in section of the prior art connectors after the connecting operation.

Next, a second embodiment of the invention is described in detail with reference to FIGS. 10 and 11. As shown in FIG. 10, a connector 20, according to this embodiment is provided with a housing main body 21 for accommodating female terminal fittings (not shown). A pair of covers 22, 23 is assembled at the rear side of the housing main body 21, and a waterproof member 24 is mounted in the housing main body 21, preferably from front. A retainer 25 is provided for locking the terminal fittings. A plurality of substantially rectangular tubular portions 26 for accommodating the terminal fittings are provided in the housing main body 21, and the terminal fittings are inserted thereinto preferably from the rear side of the housing main body 21. A receptacle 27 projects from the front end of the housing main body 21 in such a manner as to substantially entirely cover the tubular portions 26. An unillustrated mating connector can be accommodated at least partially in the receptacle 27.

The waterproof member 24 made, for example, of an elastic rubber material is mounted inside the receptacle 27 and squeezed between the connectors when the connector 20 is connected with the mating connector. The retainer 25 is mounted substantially inside the receptacle 27 and has both a function of locking the terminal fittings and a function of locking the waterproof member 24. The retainer 25 has two locking positions, namely, a partial locking position where the retainer 25 permits the terminal fittings to be inserted into the tubular portions 26 and a full locking position where the retainer 25 prevents the terminal fittings from coming out of the tubular portions 26. The full locking position is achieved by a deeper insertion of the retainer 25 into the receptacle 27.

An elastic locking portion 28 for holding the connectors connected is provided preferably at the rear side of the lateral or top surface of the housing main body 21. The elastic locking portion 28 cantilevers with its front end connected with the housing main body 21, and is elastically deformable or displaceable towards and away from the housing main body 21, preferably substantially upwardly and downwardly. The rear end of the elastic locking portion 28 preferably is widened transversely to form a pushing portion 30.

Further, protection pieces 29 project at the left and right sides of the elastic locking portion 28 while being spaced apart by a specified distance. The projecting height of the protection pieces 29 is substantially the same as or slightly more than that of the elastic locking portion 28 in its natural state, preferably when the connector 20 is mated with its mating connector (not shown).

Cover mount portions 31 are provided in the vicinity of the rear end on the left and right side wall surfaces of the housing main body 21. Each cover mount portion 31 preferably is comprised of two vertical projections 31 A extending along the vertical direction of the housing main body 21 and a connecting piece 31B connecting the centers of the vertical projections 31A. In other words, the cover mount portion 31 is substantially H-shaped. On the other hand, interlocking grooves 32 which can interlock or interact with the cover mount portions 31 are provided on the inner surface of the front end of the covers 22 and 23.

The pair of covers 22, 23 are formed substantially symmetrical with respect to each other. Upon being assembled, the covers 22, 23 form a tube for substantially covering the rear end or position of the housing main body 21. The covers 22, 23 are divided along a center line of the housing main body 21 with respect to its transverse direction, and locking portions 33 are so provided on the top and bottom surfaces of the housing main body 21 as to interlock or interact with each other to hold the covers 22, 23 assembled.

Further, a pulling portion 34 projects preferably at the front side or on a front portion of the lateral or upper surface of each of the covers 22, 23. By assembling the covers 22, 23, the pulling portions 34 are put together into a single wall piece which is located behind the elastic locking portion 28 preferably at a specified (predetermined or predeterminable) distance. The projecting height of the pulling portions 34 is substantially the same as that of the elastic locking portion 28 in its substantially natural state, preferably when the connector 20 is mated to its mating connector (not shown).

In the assembled connector 20, the pulling portions 34 and the protection pieces 29 are located at the rear, right and left sides of the elastic locking portion 28 with the rear edges of the protection pieces 29 preferably spaced apart from the pulling portions 34 by a specified distance.

The second embodiment thus constructed has substantially the same action and effects as the first embodiment.

The present invention is not limited to the foregoing embodiments. For example, embodiments as described below also are embraced by the technical scope of the present invention as defined in the claims.

In the foregoing embodiments, the projecting height of the pulling portion(s) is higher than that of the elastic locking portion in its substantially natural state. However, it is sufficient according to the present invention that the projecting height of the pulling portion(s) is higher than the position of the elastic locking portion when being elastically deformed to unlock the connectors.

Although the elastic locking portion is provided on the female connector in the foregoing embodiments, it may be provided on a male connector according to the invention.

Although the elastic locking portions 8, 28 were described as elastically returning substantially to their initial or natural state, when the connectors are mated, the elastic locking portions may remain partly deflected with respect to their initial when the connectors are mated, while the elastic locking portions substantially return to their original position or state when the connectors are separated.

Although the elastic locking portion has been described as being unitarily or integrally formed with the main body of the connector, the elastic locking portion may also be separately formed and provided with biasing means for biasing the locking portion towards a predetermined or predeterminable position.

What is claimed is:

1. A connector, comprising: a housing with opposed front and rear ends and at least one outer surface extending between the ends, the front end being configured for mating with a mating connector, an elastic locking portion formed on the outer surface of the housing and having a lock configured for engaging an engaging portion of the mating connector, the elastic locking portion having a pushing portion in proximity to the rear end of the housing for receiving forces for elastically deforming the elastic locking portion in at least a direction substantially normal to a connecting direction with the mating connector for disengaging the lock of the locking portion from the engaging portion, a pulling portion projecting undeflectably from the outer surface of the housing at a location rearwardly from the pushing portion of the elastic locking portion to enable gripping of the connector when the elastic locking portion is elastically deformed to be disengageable from the engaging portion, thereby enabling the connector to be detached from the mating connector.

2. A connector according to claim 1, wherein the pushing portion is formed by transversely widening the elastic locking portion.

3. A connector according to claim 1, the housing comprises a housing main body and at least one cover mountable on the rear end of the housing main body, wherein the elastic locking portion is provided on the housing main body and pulling portion is provided on the cover.

4. A connector according to claim 1, wherein a manipulating portion is provided on a side of the connector substantially opposed to the side on which the pulling portion is provided for further facilitating gripping and pulling the housing.

5. A connector according to claim 1, wherein the projecting height of the pulling portion is at least as high as that of the elastic locking portion when the elastic locking portion is elastically deformed sufficiently to unlock the connectors.

6. A connector according to claim 5, wherein the projecting height of the pulling portion from the outer surface of the housing is higher than that of the pushing portion of the elastic locking portion in its natural state where no force is acting thereon.

7. A connector according to claim 6, wherein at least one protection piece is provided so as to substantially surround at least a portion of the elastic locking portion from sides other than a mating side of the connector with its mating connector.

8. A connector according to claim 7, wherein the protection piece has substantially the same projecting height as the pulling portion.

9. A connector assembly comprising a first connector having an elastic locking portion formed on an outer surface thereof and a second connector engageable with the first connector along a connecting direction, the second connector having an engaging portion formed on an outer surface thereof, the elastic locking portion of the first connector being elastically deformable in at least a direction substantially normal to the connecting direction and being dimensioned to releasably engage the engaging portion of the second connector, a pulling portion being disposed on an outer surface of the first connector at a location spaced from but in proximity to the elastic locking portion and disposed such that the elastic locking portion is between the pulling portion and the second connector, the pulling portion projecting further from the outer surface then elastic locking portion when the elastic locking portion is deformed to enable gripping of the first connector while deforming the elastic locking portion for enabling the first connector to be detached from the second connector.

* * * * *